United States Patent [19]

Gray

[11] Patent Number: 4,676,528

[45] Date of Patent: Jun. 30, 1987

[54] METHOD AND APPARATUS FOR RESTORING TUBULAR UPSETS

[76] Inventor: Theodor R. Gray, 115 William Dr., Lafayette, La. 70508

[21] Appl. No.: 856,981

[22] Filed: Apr. 29, 1986

Related U.S. Application Data

[63] Continuation of Ser. No. 605,199, Apr. 30, 1984, abandoned.

[51] Int. Cl.[4] ..... F16L 55/00

[52] U.S. Cl. ..... 285/15; 285/334; 285/286

[58] Field of Search ..... 29/402.03–402.08; 285/334, 333, 286, 355, 390, 15; 166/242; 175/320

[56] References Cited

U.S. PATENT DOCUMENTS

| | | | |
|---|---|---|---|
| 295,347 | 3/1884 | Cameron . | |
| 1,364,478 | 1/1921 | Boyd et al. . | |
| 1,562,372 | 11/1925 | Sheldon . | |
| 1,859,809 | 5/1932 | Timbs . | |
| 2,196,966 | 4/1940 | Hammer . | |
| 2,206,166 | 7/1940 | Dunn | 285/334 |
| 2,232,135 | 2/1941 | Pate . | |
| 2,239,942 | 4/1941 | Stone et al. . | |
| 2,259,232 | 10/1941 | Stone | 285/286 |
| 2,298,049 | 10/1942 | Gardner . | |
| 2,301,495 | 11/1942 | Abegg | 285/333 |
| 2,402,003 | 6/1946 | Zublin | 285/333 |
| 2,420,139 | 5/1947 | Kelly . | |
| 2,482,962 | 9/1949 | Boice . | |
| 2,626,190 | 1/1953 | Boice . | |
| 3,326,581 | 6/1967 | Wong . | |
| 3,572,771 | 3/1971 | Redwine . | |
| 3,822,902 | 7/1974 | Maurer et al. . | |
| 3,923,324 | 12/1975 | Cruickshank et al. . | |
| 3,978,923 | 9/1976 | Stone . | |
| 4,026,583 | 5/1977 | Gottlieb . | |
| 4,085,951 | 4/1978 | Morris . | |
| 4,192,533 | 3/1980 | Blose | 285/355 |
| 4,399,877 | 8/1983 | Jackson et al. . | |
| 4,431,219 | 2/1984 | Brewer et al. . | |
| 4,515,218 | 5/1985 | Bissonnette . | |

FOREIGN PATENT DOCUMENTS

| | | |
|---|---|---|
| 657262 | 5/1929 | France . |
| 243307 | 4/1926 | United Kingdom . |
| 262886 | 12/1926 | United Kingdom . |

OTHER PUBLICATIONS

"Tubing Joints for High-Pressure Wells" by Kelly et al., *Drilling and Production Practice 1949,* API.

*Primary Examiner*—Andrew V. Kundrat
*Assistant Examiner*—Anthony Knight
*Attorney, Agent, or Firm*—George A. Bode

[57] ABSTRACT

A tubular upset extension apparatus which prolongs the usefulness of upsetted tubing joints used in drilling oil, gas and water well bore holes. The upset extension apparatus is fitted onto hollow bore tubing having shortened and specially threaded box and pin joints and a beveled peripheral shoulder at the inner terminal of the threads. The upset extension apparatus likewise has a hollow bore and specially threaded male and female ends which are rotatably engageable with the shortened tubing upsets. An exterior, non-bore penetrating circumferential groove is defined by the point of intersection of the shoulders of the upset extension and the shortened tubing upset. The circumferential groove receives a cosmetic weld, non-thread and non-bore penetrating weld which rigidly secures the upset extension to the shortened upset and maintains the internal and external integrity of the engaged sections.

5 Claims, 6 Drawing Figures

METHOD AND APPARATUS FOR RESTORING TUBULAR UPSETS

This is a continuation of application Ser. No. 605,199 filed Apr. 30, 1984, now abandoned.

BACKGROUND OF THE INVENTION

1. Field of the Invention

The present invention relates to upsetted hollow bore tubing, drill pipe, and the like having box and pin joints on opposing ends. Upsetted tubing and drill pipe are used in the drilling, production and reworking operations of oil, gas and water wells. The present invention more particularly relates to prolonging the usefulness of a section of upsetted tubing, drill pipe and the like by removing the damaged portions of the upsets having either a box and pin joint and adding an upset extension with either a box and pin joint. The upset extensions have the same outer diameter and the same inner bore diameter as the upsets of existing sections of tubing, drill pipe and the like.

2. General Background

Sections of upsetted hollow bore tubing, drill pipe and the like having box and pin joints on opposing ends are commonly used in the drilling, production and reworking of oil, gas and water wells. A section of upsetted tubing or drill pipe is generally thirty feet long. Multiple sections of tubing or drill pipe are connected together at the rotary table of a rig to form a drill, work or production string. A tubing or drill string is formed by rotatably engaging the threaded connections of the box joint on one section of tubing to the threaded connection of the pin joint of another section of tubing. After a tubing section is so connected, it is lowered into the bore hole and other sections of tubing are connected in like manner until the desired length of the tubing string is achieved.

Upsetted tubing or drill pipe may perform functions in the bore hole. In a rotary drilling operation, besides being used as a drill string, upsetted tubing may be inserted in the bore hole to test and produce the well after the hole has been drilled and casing has been set to prevent pressure from causing the hole to collapse. A string of upsetted tubing is also used to clear a bore hole that has been blocked by cement plugs, lost tools and the like. Upsetted tubing is also used after a bore hole has been drilled to place flow regulation equipment in the bore hole as well as to ream, clean and swab the hole to maintain production.

Box and pin joints on the upsets of tubing are susceptible to damage while the tubing is being transported to and from the drilling rig as well as while sections of tubing are being connected to one another in the formation of a string of tubing. Thread damage to the box or pin joints may be repaired, by cutting off the damaged area of the upset and machining new threads in the joint. However, where the damage to the upset requires removal of substantially all of the upset or where an upset has been repeatedly damaged and machined to a point where the upsetted joint is too short to be useful, the entire thirty foot section of tubing must be scrapped. Discarding an entire section of tubing or drill pipe because of a damaged or shortened upset is wasteful and costly.

Methods for protecting the joints of tubing upsets from damage and thereby prolonging their usefulness have been used commercially in the oil industry. Some drill tube connectors, wear collars and the like have been patented. Several are noted hereinafter.

U.S. Pat. No. 1,859,809 issued to E. Timbs shows a tool joint with a lock ring sub. The tool joint has a weld locking means which prevents the tool joint from backing off of its threads when exposed to high fluid pressures.

U.S. Pat. No. 1,364,478 issued to P. Boyd and A. M. Saunders shows an intermediate coupling used to join two tube sections. The coupling has a surplus shoulder length, that may be cut back and rethreaded when the original threads become damaged.

U.S. Pat. No. 2,232,135 issued to W. Pate discloses a replacement sleeve or ring which is slidable over and welded to sections of drill stems.

U.S. Pat. No. 2,298,049 issued to Robert I. Gardner shows a tool joint internally threaded at both ends to receive drill pipe at one end and a tool shank at the other end. The tool joint has a main cylindrical body of steel over which is secured a relatively thick outer wear sleeve of austentic manganese steel.

U.S. Pat. No. 2,420,139 issed to F. R. Kelly shows a coupling designed to be welded onto a pipe line in order that a section of pipe may be turned to allow for the repair of corrosion on the outside bottom of the pipe section.

U.S. Pat. No. 2,482,962 issued to Elvin G. Boice shows a wear collar or sleeve for tool joints which will remain coupled to a section of drill pipe as a drill stem is dismantled.

U.S. Pat. No. 2,626,190 issued to Elvin G. Boice discloses a tool joint of the shrink grip type having a section onto which hard metals may be welded in the field without disturbing the connection between the joint and the pipe.

U.S. Pat. No. 3,572,771 issued to Fletcher Redwine shows connectors for drill collars that are made of highly wear resistent material such as titanium or a titanium-base alloy.

U.S. Pat. No. 3,923,324 issed to James R. Cruickshank and Rainer Jurgen discloses a drill collar body having a sub with threaded connections frictionally mounted by means of a shrink fit.

The foregoing patents show some methods and apparatus for extending the life of sections of tubing. These devices however fail to disclose the method and apparatus of the present invention which in a straightforward and easy manner solves the problem of repairing sections of tubing, drill pipe or the like whose upsets have been shortened to such an extent that further rethreading is not feasible.

GENERAL DISCUSSION OF THE PRESENT INVENTION

The preferred embodiment of the present invention is a method and apparatus for prolonging the usefulness of upsetted tubing joints used in the drilling, reworking and production of oil, gas and water well bore holes. The method features the removal of the damaged portions of the box or pin joint of the upset and the engagement of a box or pin joint extension.

In the preferred embodiment of the present invention the box or pin joint extensions are manufactured from hollow bore steel having the same properties as the tubing upset to which it will be connected.

The box and pin joint extensions in the preferred embodiment are machined to have the same bore diameter and the same outer diameter as the tubing to which they are attached. As a consequence, as drilling and production fluids are circulated, fluid turbulence in the bore hole or in the bore of the tubing is no greater than that associated with new tubing. Thus, the box and pin joint extensions are subject to no greater strain or wear than new tubing.

Other noteworthy features of the present invention include the dual means for securing the joint extensions to the tubing upset which is being refurbished. The first securing means are specially machined threaded connections, peripheral shoulders and annular sealing surfaces. The second is a cosmetic weld, i.e., non-bore and non-thread penetrating.

The tubing upset joint receiving the joint extension and the joint extension are machined in such a manner as to have corresponding threads, peripheral shoulders and annular sealing surfaces. If the tubing upset being repaired is a box joint, the box joint extension will have a male end which has threads, peripheral shoulders and annular sealing surfaces which engage the threads, peripheral shoulders and annular sealing surfaces of the box joint of the tubing upset. In like manner, if the upset to be repaired has a pin joint, it will be fitted with the female end of a pin joint extension. When the joint extensions are threadedly connected to the tubing upset joint, the mating peripheral shoulders and annular sealing surfaces of the joint extensions and the tubing upsets are contiguous and form impermeable metal to metal seals.

The weld used to secure a joint extension to the tubing upsets is primarily designed to maintain the integrity of the metal to metal seals and to prevent the joint extensions from backing off of the refurbished tubing when a pipe string is removed from the bore hole and broken down.

The weld is placed in a circumferential groove around the outer diameter of the engaged joint extension and the joint of the refurbished tubing. Both the joint extension and the joint of the refurbished tubing have a beveled edge at the point of union of their external shoulders in order to form the weldreceiving groove. The weld is machined to the same outer diameter as the joint extension and the upset of the existing tubing.

In the preferred embodiment of the present invention, the weld penetrates neither the threads nor the bore of the joint extension or joint of the refurbished tubing; thus, the structural integrity of the bore is not weakened, so the refurbished upset maintains the same internal and external pressure integrity as an upset on a new section of tubing.

It can be seen that should the extension joints become damaged, the weld may be removed, the damaged extension joint unthreaded and a replacement extension joint threaded and welded into place.

Commonly, a box or pin joint of tubing has a multistep thread profile having thread flanks of different diameters and stops or shoulders placed at intervals along the flanks. The stops or shoulders protect the threads from deterioration caused by excessive torque. The box or pin joint extensions of the preferred embodiment of the present invention may be manufactured using any thread profile in use in the industry.

The method of the present invention for restoring upsetted tubing, drill string and the like may also be used to restore the usefulness of damaged safety valves, cross-over valves and pup joints. The procedure is the same, i.e., removing the damaged or shortened tubular sections, machining threads and a beveled edge onto the remaining tubular section that are compatible with the extensions, engaging the extensions and placing a cosmetic weld around the circumferential groove.

It is among the objects of the present invention to provide a method and apparatus for prolonging the usefulness of upsetted tubing, drill pipe and the like used to drill, work and produce oil, gas and water well bore holes.

It is another object of the present invention to provide an upset extension for box and pin joints having the same bore diameter and the same outer diameter as the upset of the existing tubing.

It is another object of the present invention to provide an upset extension for box and pin joints with multiple internal seals that may be produced with a plurality of thread profiles.

It is another object of the present invention to provide an upset extension for box and pin joints that does not back off when the drill, work or production string is dismantled.

It is another object of the present invention to provide a method for restoring the usefulness of damaged or shortened tubular sections of safety valves, cross-over subs and pup joints

BRIEF DESCRIPTION OF THE DRAWINGS

For a further understanding of the nature and objects of the present invention, reference should be had to the following detailed description, taken in conjunction with the accompanying drawings, in which like parts are given like reference numbers wherein.

DETAILED DESCRIPTION OF THE PREFERRED EMBODIMENT

Figure 2:
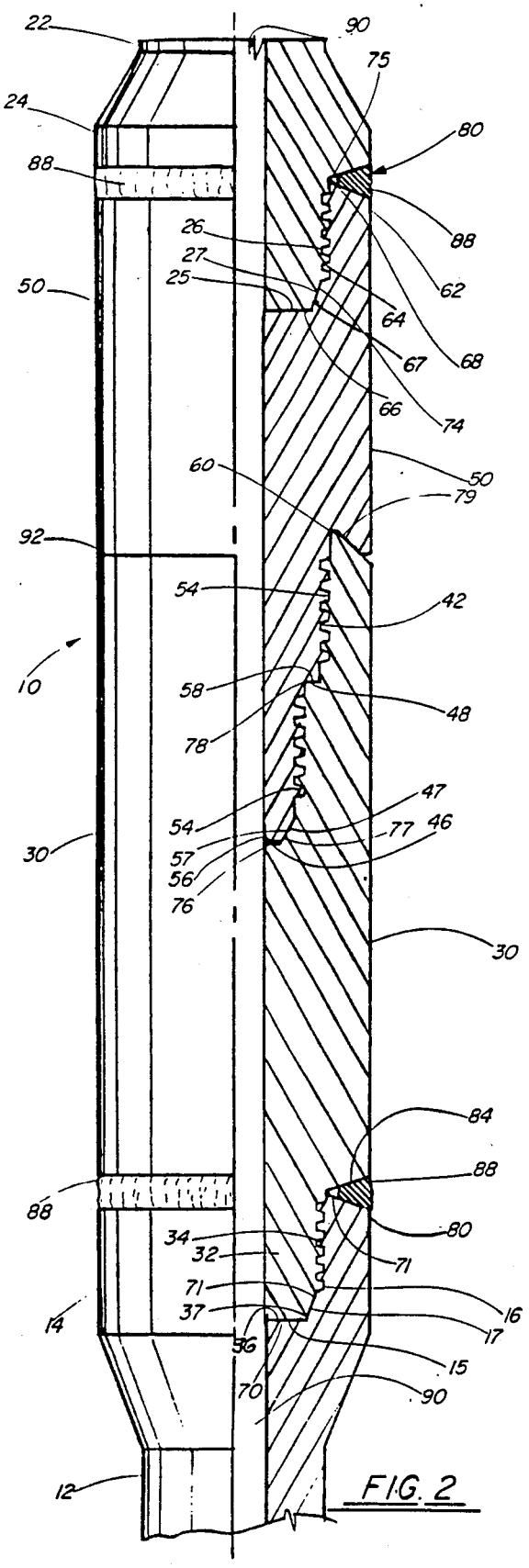
FIG. 2 is a partial sectional view of the apparatus of the present invention.
Figure 1:
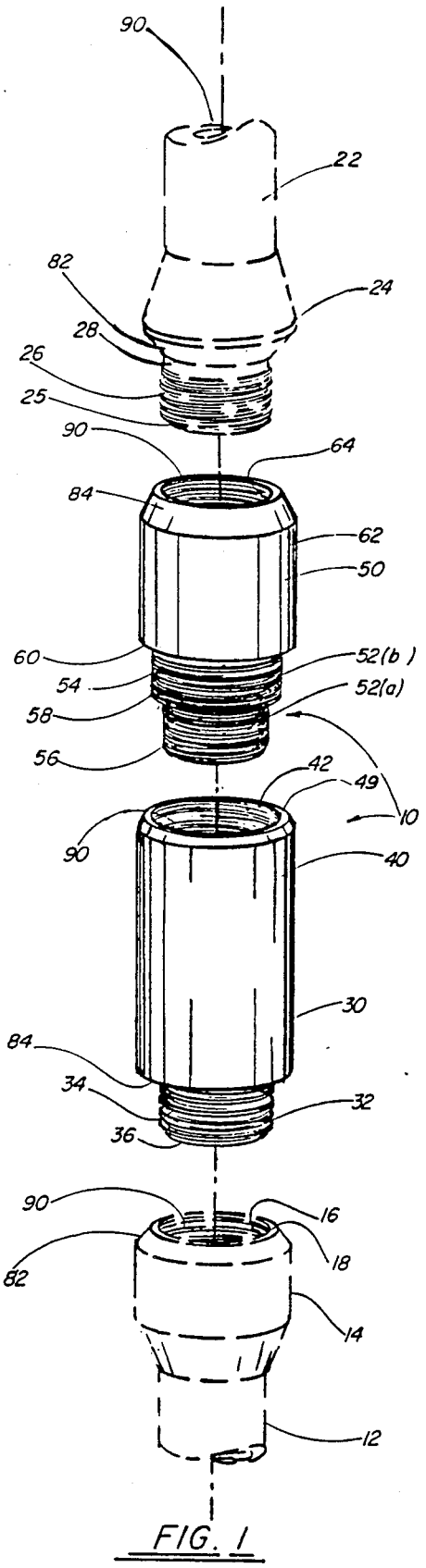
FIG. 1 is an exploded view of the preferred embodiment of the apparatus of the present invention.
Figure 3:
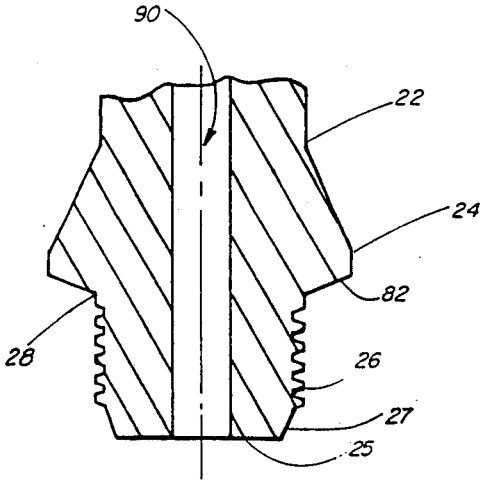
FIG. 3 is a partial sectional view of the pin joint of existing tubing modified to receive the pin joint extension of the preferred embodiment of the present invention.
Figure 5:
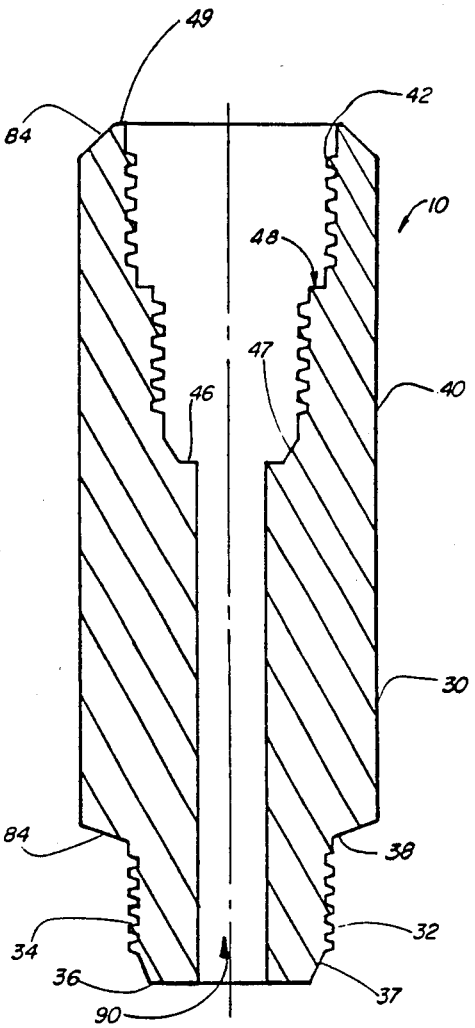
FIG. 5 is a partial sectional view of the box joint extension of the preferred embodiment of the present invention.
Figure 4:
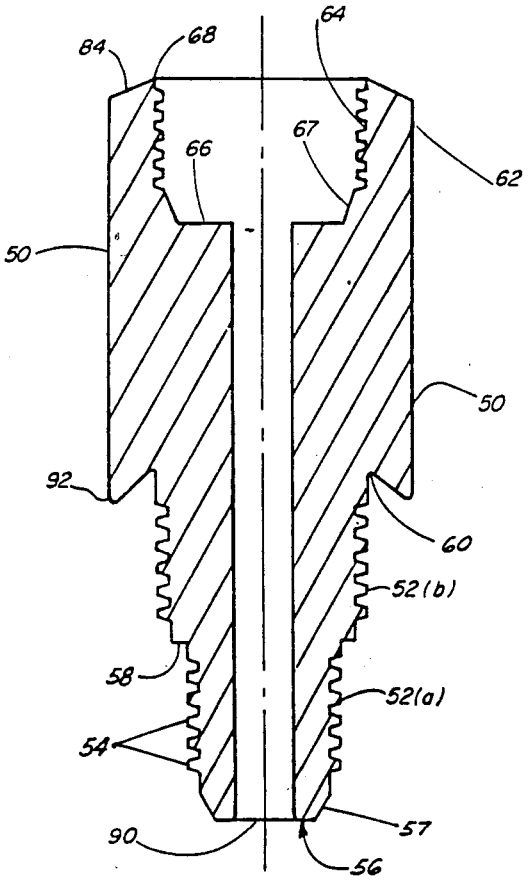
FIG. 4 is a partial sectional view of the pin joint extension of the preferred embodiment of the present invention.
Figure 6:
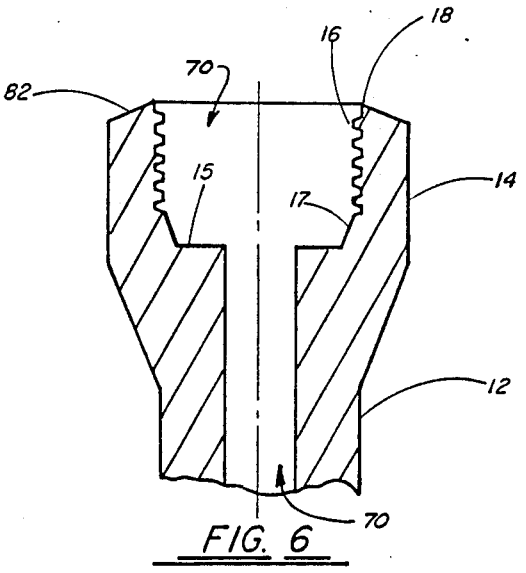
FIG. 6 is a partial sectional view of the box joint of existing tubing modified to receive the box joint extensions of the preferred embodiment of the present invention.

FIGS. 1, and 2 illustrate best the preferred embodiment of the apparatus of the present invention designated generally by the numeral 10. Upset extension assembly 10 is comprised generally of box joint extension 30 (FIG. 5), and pin joint extension 50 (FIG. 4). Box joint extension 30 couples with upset box joint 14 of existing tubing 12 (FIG. 6). Pin joint extension 50 couples with upset pin joint 24 (FIG. 3) of existing tubing 22. The female threaded portion 16 of joint 12 attaches to the male threaded end portion 32 of extension 30. The female threaded end portion 40 of extension 30 threadably attaches to the male end portion 52*a,b* of extension 50. The female end portion 62 of extension 50 threadably attaches to the pin or male end portion 26. These connections are threadable connections with the connections being possible because the threads of each connection are corresponding. A complete assembly can be seen in FIG. 2 in a partial sectional view.

Butt welds 88 fill circumferential grooves 80 so that a permanent welded connection can be made between existing tubing 22 and extension 50. A similar groove 80 defines a circumferential groove to which butt weld 88 can be applied forming a permanent connection and seal between section 12 and extension 30. In this way, the sections 12, 22 are repaired and extended so that a new pin/box connection is formed to the old drill pipe. In FIG. 2, this new connection is shown as 92 in the drawings.

Existing tubing 12 has upset box joint 14 which has internal annular shoulder 15 which angularly intersects another annular surface 17. In section, the surfaces 15, 17 preferably form an obtuse angle. Internal threads 16 are cut between annular surface 17 and terminate at external annular edge 18 (see FIG. 6).

Existing tubing 22 has upset pin joint 24 which has an internal annular shoulder 25 angularly intersecting a second annular surface 27. Internal threads 26 are cut between annular surface 27 and external annular shoulder 28 (see FIG. 3).

Box joint extension 30 has a first male end portion 32 and an opposite female end portion 40 with an internal continuous bore connecting the end portions 32, 40. Male end 32 includes internal shoulder 36 and angularly intersecting annular shoulder surface 37. External threads 34 are cut between annular surface 37 and bevel surface 84 (see FIG. 5).

A multiple seal thread profile is illustrated on female end 40. Female end portion 40 has internal shoulder 46 angularly intersecting annular surface 47. Internal threads 42 are cut between annular surface 47 and internal stop 48 as well as between annular edge 48 and external shoulder 49.

Pin joint extension 50 (FIG. 4) has female end portion 62 which is opposite the male end 52*a,b*. A continuous internal bore connects ends 52*a,b* and 62. Female end 62 has an internal annular shoulder 66 which intersects an adjacent annular surface 67. Internal threads 64 are cut between annular surface 67 and annular edge stop 68 (see FIG. 4).

A typical multiple seal thread profile corresponding to that found on female end 40 of box joint extension 30 is provided on male end 52*a,b*, so that the two parts 50, 30 can be threadably assembled as shown in FIG. 2. The outer diameter of male end 52*a* is somewhat reduced from the outer diameter of male end 52*b*. Male end 52*a,b* has an annular shoulder 56 which angularly intersects a second annular surface 57. External threads 54 are cut between annular surface 57 and annular stop 58 as well as between annular stop 58 and annular edge 60.

FIG. 2 illustrates the coupled assembly 10 with existing tubing 12, 22. Box joint extension 30 is coupled with upset box joint 14 by threadably engaging the male end portion 32 of box joint extension 30 into the bore 70 of box joint 14. When box joint extension 30 is coupled with box joint 14, internal female threads 16 of box joint 14 are threadably joined to external threads 34 of male end portion 32 of box joint extension 30. When box joint 14 and box joint extension 30 are completely connected, internal shoulder 15 and annular surface 17 correspondingly abut internal shoulder 36 and annular surface 37, respectively to form metal to metal seals. Further, annular edge 18 abuts annular edge 38 to form a metal to metal seal at 71.

Pin joint extension 50 is coupled with upset pin 24 by threadably engaging male end portion 25 with female end 62. When so engaged, external threads 26 are engaged with internal threads 64 and annular shoulders 25, 27 correspondingly abut internal annular shoulder 66, 67 to form metal to metal seals at 74. In like manner, annular edge 28 abuts annular edge 68 to form a metal to metal seal at 75.

Once box joint extension 30 is threaded securely to upset box joint 14 and pin joint extension 50 is threaded securely to upset pin joint 24, beveled edges 82 and 84 form circumferential groove 80. Groove 80 provides a groove for the placement of butt weld 88 to secure rigidly upset box joint 14 to box joint extension 30 and to secure upset pin joint 24 to pin joint extension 50 (see FIG. 2).

When a string of pipe is made up using existing tubing 12 and 22 that has been refurbished by the attachment of upset extension assembly 10, male end 52*a,b* of pin joint extension 50 is threaded securely to female end 40 of box joint extension 30. When so engaged, internal shoulder 46, annular surface 47, internal stop 48 and external shoulder 49 of box assembly 30 correspondingly abut internal shoulder 56, annular surface 57, internal stop 58 and annular edge 60 to form metal to metal seals at 76, 77, 78 and 79 respectively.

The engagement of box joint extension 30 and pin joint extension 50 as described forms tubular bore 90 which has a continuous substantially equal inner diameter. The outer diameter of pin joint extension 50 and box joint extension 30 of extension assembly 10 are likewise substantially equal to the outer diameter of existing tubing 14, 24. The new pin/box connection 92 is thus formed at the juncture of box joint extension 30 and pin joint extension 50. This new connection allows sufficient metal to be remilled when the extensions 30, 50 need future repair or rethreading.

It can be seen that should the joint extensions 30, 50 become damaged, weld 88 may be removed, the damaged extension joint unthreaded, and a replacement extension joint threaded and welded into place.

Commonly, a box or pin joint of tubing, such as existing tubing 12, 22, has a multi-step thread profile having thread flanks of different diameters and stops or shoulders placed at intervals along the flanks. The stops or shoulders protect the threads from deterioration caused by excessive torque. The box or pin joint extensions 30, 50 of the preferred embodiment of the present invention may be manufactured using any thread profile in use in the industry.

The method of the present invention for restoring upsetted tubing, drill string and the like may also be used to restore the usefulness of damaged safety valves, cross-over valves and pup joints. The procedure is the same, i.e., for removing the damaged or shortened tubular sectins, machining threads and a beveled edge into the remaining tubular section that are compatible with the extensions 30,50, engaging the extensions and placing a cosmetic weld 88 around the circumferential groove 80.

Because many varying and different embodiments may be made within the scope of the inventive concept herein taught, and because many modifications may be made in the embodiments herein detailed in accordance with the descriptive requirement of the law, it is to be understood that the details herein taught are to be interpreted as illustrative and not in a limiting sense.

What is claimed as the invention is:

1. A tubular upset extension apparatus for prolonging the usefulness of a well drilling tubing joint having an upset threaded end portion, comprising:

a. a shortened extension member of hollow bore tubing having a first annular threaded section and a first beveled peripheral shoulder positioned at one end of the first threaded section;

b. a second elongated section of upset tubing that has been damaged in the thread area, and with the damaged portion removed, the remaining upset portion being provided with additional thread forming a second annular threaded section that is rotatably engagable with said first threaded section;

c. said second section including a second beveled peripheral shoulder which aligns with said first beveled shoulder when said first and second threaded sections are fully engaged, in which position said beveled shoulders define an annular weld receptive recess that provides an exterior, non-bore penetrating circumferential groove defined by the point of intersection of said first and second beveled shoulders; and d. weld means for rigidly securing together said first and second sections at the weld recess while maintaining the internal and external integrity of the engaged threaded sections so that said weld means prevents a disengagement of said first and second threaded sections, said weld means having an outer diameter substantially equal to the outer diameters of said engaged first and second sections at the upset portion.

2. The apparatus of claim 1 having a continuous inner bore of uniform diameter.

3. The apparatus of claim 1 having an outer upset of uniform diameter.

4. The apparatus of claim 1 wherein the internal hollow bores of the engaged first and second sections are contiguous and aligned upon assembly to define a uniform continuous bore of constant diameter.

5. A joint extension for oil well drill pipe tubular members having enlarged diameter upset end portions carrying respective pin and box threaded sections, comprising:

a. an enlarged tubular body having an outer surface, a flow conveying bore, and said first and second male and female threaded respective pin and box portions at the ends thereof;

b. a first beveled peripheral annular shoulder on one end of said tubular body, extending radially from one of said threaded sections to the outer surface of said upset end portions;

c. a second beveled peripheral annular surface extending from the upset end portion outer surface to the other of the threaded sections;

d. one of said threaded sections being damaged in the thread area and with the damaged portion removed, the body member being provided with additional thread in the remaining upset portion; and e. a cooperating threaded extension member connectable to said tubular body by threaded engagement with said additional threaded end portion thereof, said extension member including a cooperating annular shoulder that registers with said first annular shoulder upon assembly to close said bore to define an external recess, said external recess defining an annular weld groove that can be sealed with a butt-type annular weld having an outer diameter substantially equal to the outer diameters of the engaged additional threaded end portion and threaded extension member at the upset portion.

* * * * *